US007954749B2

(12) United States Patent
Dunn

(10) Patent No.: US 7,954,749 B2
(45) Date of Patent: Jun. 7, 2011

(54) EXTRUDED CYLINDER WITH A SOLID WOOD EXTERIOR

(75) Inventor: Randolph A Dunn, Wilton, NH (US)

(73) Assignee: Randolph A. Dunn, Wilton, NH (US)

( * ) Notice: Subject to any disclaimer, the term of this patent is extended or adjusted under 35 U.S.C. 154(b) by 6 days.

(21) Appl. No.: 12/328,800

(22) Filed: Dec. 5, 2008

(65) Prior Publication Data

US 2009/0145994 A1 Jun. 11, 2009

Related U.S. Application Data

(60) Provisional application No. 60/992,350, filed on Dec. 5, 2007.

(51) Int. Cl.
*B65H 75/18* (2006.01)

(52) U.S. Cl. ..... 242/610.4; 242/609.4; 156/91; 156/297

(58) Field of Classification Search ..... 242/600, 242/604, 608.8, 609, 609.4, 610, 610.4, 613, 242/613.4, 118, 118.1; 156/91, 92, 297, 156/244.1

See application file for complete search history.

(56) References Cited

U.S. PATENT DOCUMENTS

| | | | | | |
|---|---|---|---|---|---|
| 503,227 | A | * | 8/1893 | Benham | 242/608.4 |
| 1,015,244 | A | * | 1/1912 | Parker | 242/610.4 |
| 1,753,342 | A | * | 4/1930 | Hubbard | 242/610.4 |
| 1,881,911 | A | * | 10/1932 | Howard | 242/610.4 |
| 2,365,980 | A | * | 12/1944 | Thomas | 242/573.5 |
| 2,977,066 | A | * | 3/1961 | Kimmel | 242/609 |
| 4,034,932 | A | * | 7/1977 | Ferch | 242/610.4 |
| 5,147,722 | A | | 9/1992 | Koslow | |
| 5,585,155 | A | | 12/1996 | Heikkila et al. | |
| 6,007,656 | A | | 12/1999 | Heikkila et al. | |
| 6,106,944 | A | | 8/2000 | Heikkila et al. | |
| 2005/0015986 | A1 | * | 1/2005 | Stebnicki et al. | 29/895.32 |
| 2005/0133951 | A1 | | 6/2005 | Muller et al. | |

FOREIGN PATENT DOCUMENTS

| | | | |
|---|---|---|---|
| EP | 0605914 | A1 | 7/1994 |
| EP | 0747205 | A2 | 12/1996 |
| EP | 1250995 | A1 | 10/2002 |

* cited by examiner

*Primary Examiner* — William A Rivera
(74) *Attorney, Agent, or Firm* — Vern Maine & Associates

(57) ABSTRACT

A method and is disclosed for the production of winding cores having a solid wood exterior. The method comprises adhering a plurality of staves about the exterior of the extruded wood core, such that those staves form a shell.

16 Claims, 5 Drawing Sheets

EXTRUDED CYLINDER WITH A SOLID WOOD EXTERIOR

RELATED APPLICATIONS

This application claims the benefit of U.S. Provisional Application No. 60/992,350, filed Dec. 5, 2007 and is herein incorporated in its entirety by reference.

FIELD OF THE INVENTION

The invention relates to a winding core and bolt, and more particularly, to an extruded wood fiber core with an applied solid wood exterior shell.

BACKGROUND OF THE INVENTION

Wood fiber cores have been used in applications utilized for winding or spooling industrial products. Extruded wood fiber cores, such as those manufactured by the assignee since the mid 1960's, have been suitable for applications where low cost is valued, and where durability is not essential. Wood fiber cores have excellent compressive strength in the axial direction, but only moderate or poor tensile strength in the transverse direction. Such fiber cores may be extruded or molded. Wood fiber cores are typically limited to single use as they lack beam strength, and unwinding of materials from the core can produce cracks, fissures or other structural defects rendering them inoperative.

Solid wood cores are manufactured using labor intensive machining of lumber, gluing, clamping and various steps. While more expensive than extruded core, the solid wood provides improved structural integrity for heavier materials or multiple use applications. Such solid wood cores are of particular value in intracompany uses. Such solid wood cores have improved beam strength.

Similarly, the steel cores are highly durable, but require expensive fabrication and welding, are heavy, and are expensive to ship.

What is needed, therefore, are techniques for providing durable, reusable cylinders manufacturable with low labor.

SUMMARY OF THE INVENTION

One embodiment of the present invention provides a method for the production of winding cores with a solid wood exterior, the method comprising: providing a extruded wood core column; providing a plurality of solid wood staves having an interior profile mating an exterior profile of the extruded wood column; applying an adhesive to the interior profile of the staves and the exterior profile of the core; adhering the interior profile of each of the staves to the exterior profile of the core; mechanically securing the staves to the core; allowing the adhesive to cure providing a winding core with a solid wood exterior.

Another embodiment of the present invention provides such a method further comprising placing at least one steel band about an end of the winding core with the solid wood exterior and embedding the band in the solid wood exterior.

A further embodiment of the present invention provides such a method further comprising disposing at least one end cap on an end of the winding core with the solid wood exterior and crimping the end cap to secure it to the winding core with the solid wood exterior.

Yet another embodiment of the present invention provides such a method wherein step of mechanically securing comprises nailing the staves to the extruded core.

A yet further embodiment of the present invention provides such a method wherein the step of mechanically securing comprises clamping the staves to the extruded core.

Still another embodiment of the present invention provides such a method further comprising machining the staves from wood of a variety selected from the group of wood varieties consisting of poplar, oak, ash, maple, mahogany, and walnut.

A still further embodiment of the present invention provides such a method wherein the wood is an exotic species of wood.

Even another embodiment of the present invention provides such a method further comprising fluting the staves.

An even further embodiment of the present invention provides such a method further comprising shaping the staves such that the solid wood exterior is tapered.

Still yet another embodiment of the present invention provides such a method wherein the solid wood exterior comprises a parabolic frustrum.

One embodiment of the present invention provides a structural unit; the structural unit comprising: a extruded core comprising wood fiber and a thermoset resin having a central hole coaxial with a major axis of the core and an exterior; a plurality of shaped staves forming a shell, each stave of the plurality of staves disposed about the exterior of the core and parallel to the major axis.

Another embodiment of the present invention provides such a structural unit further comprising at least one slot disposed in at least one the stave is provided parallel to the axis.

A further embodiment of the present invention provides such a structural unit wherein the plurality of staves form a cylindrical shell around the core.

Yet another embodiment of the present invention provides such a structural unit wherein shell has groves where the staves meet.

A yet further embodiment of the present invention provides such a structural unit wherein the staves are manufactured from a wood, the wood being of a wood species selected from the group of species consisting of poplar, pine, oak, mahogany and walnut.

Still another embodiment of the present invention provides such a structural unit wherein the staves are tapered, such that the staves form a smooth, longitudinally tapered shell around the core.

A still further embodiment of the present invention provides such a structural unit, wherein the shell is fluted.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
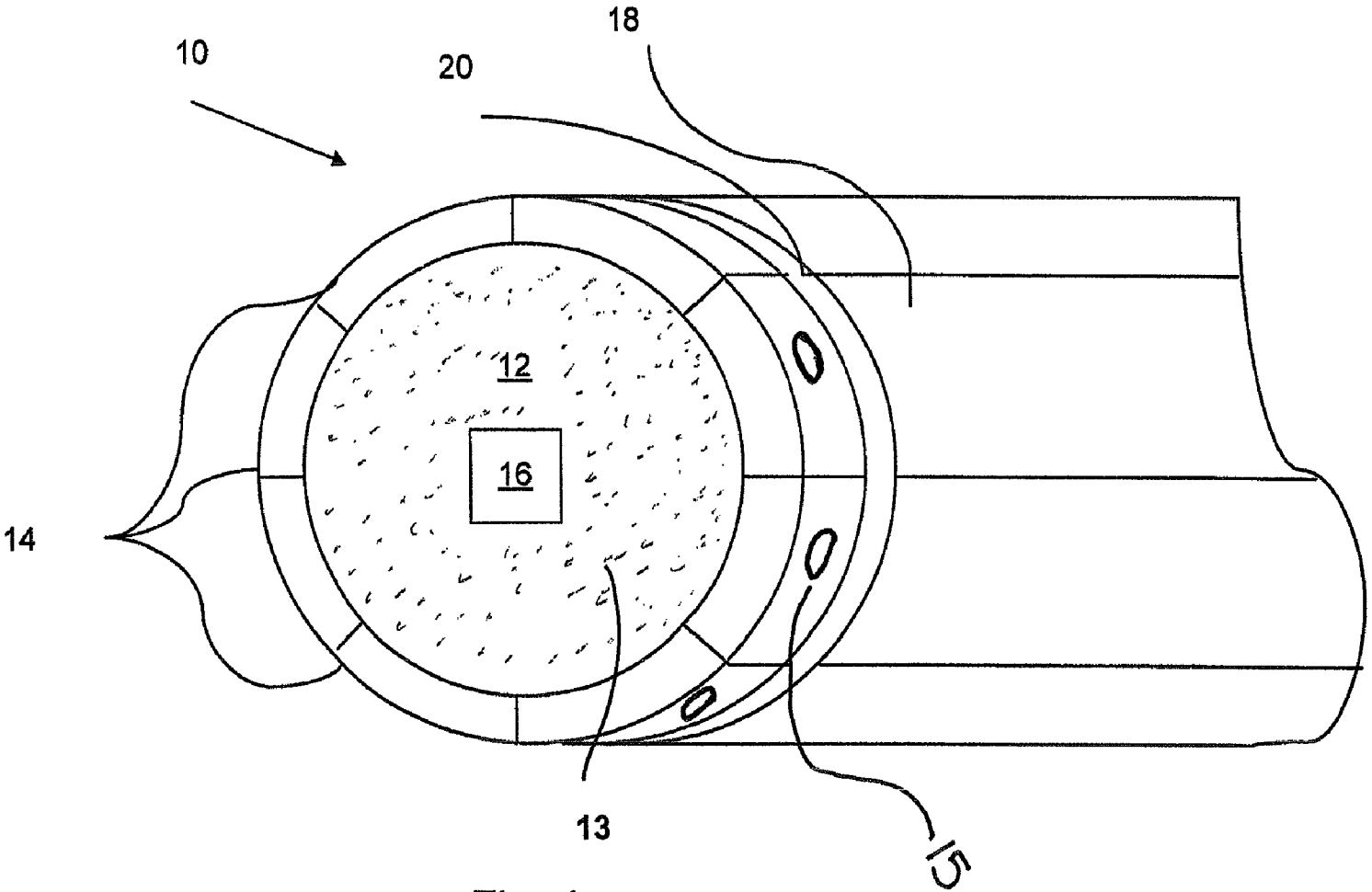
FIG. 1 is a perspective drawing illustrating an extruded core cylinder with a solid wood shell configured in accordance with one embodiment of the present invention.

As illustrated in FIG. 1, a cylinder 12 of extruded wood fiber disposed in a resin matrix 13 is provided by one embodiment of the present invention. The extruded core 12 is covered in a shell 18 of wooden staves 14. In one embodiment of the present invention, each stave 14 covers one eighth of the circumference of the extruded core 12. Staves 14, according to one embodiment of the present invention, are glued to the exterior of the extruded core 12. Nails 15 may be used to affix the staves 14 to the core 12 while the glue cures, and may add additional strength to the bond between the staves 14 and the core 12. During manufacture, staves 14 may be clamped to the core 12 to insure proper curing of the adhesive manually, using pipe clamps or other suitable hand clamp with a circular pressure ring, or may be clamped using a automated device whereby pressure is applied to the circumference of the stave shell. In one such embodiment pneumatic pressure may be applied, such as by an air choke. For example, Air Flex® clutch break single and double flange elements, part no. 142197JA sold by Eaton Corporation may be used. A central extruded bore 16 is provided through the core 12 to permit the introduction of shafts or other mounting means as necessary. Staves 14, are illustrated in greater detail in FIGS. 2A-3C.

Figure 4:
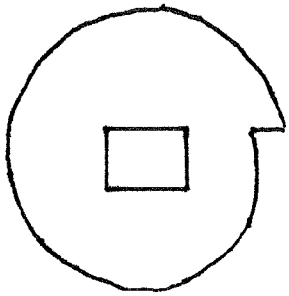
FIG. 4 is a cross sectional plan view illustrating an extruded core cylinder with a solid wood shell configured in accordance with one embodiment of the present invention and having a spiraled cross section.
Figure 5:
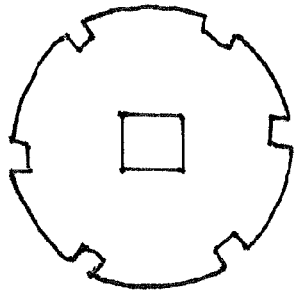
FIG. 5 is a cross sectional plan view illustrating an extruded core cylinder with a solid wood shell configured in accordance with one embodiment of the present invention and having retention slots disposed in the solid wood shell.
Figure 6:
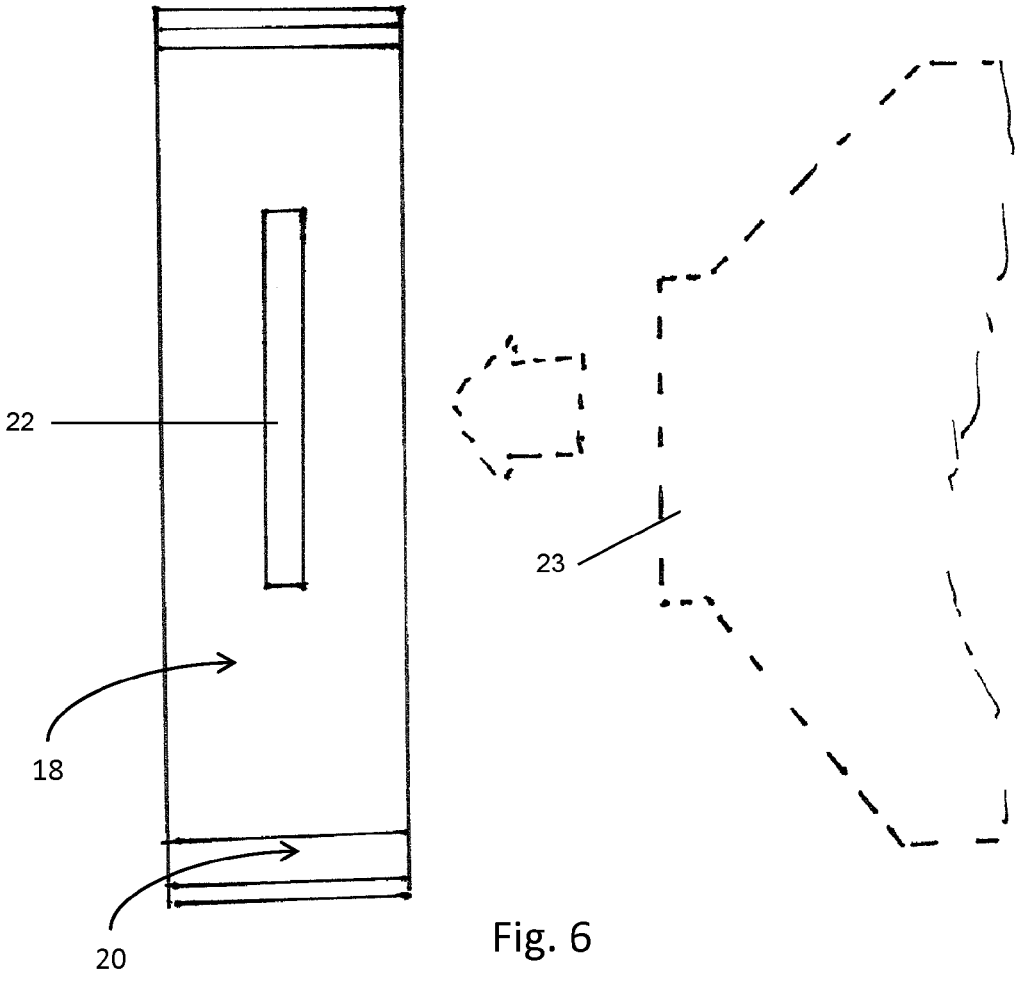
FIG. 6 is an elevation view illustrating an extruded core cylinder with a solid wood shell configured in accordance with one embodiment of the present invention having a retention slot.
Figure 7:
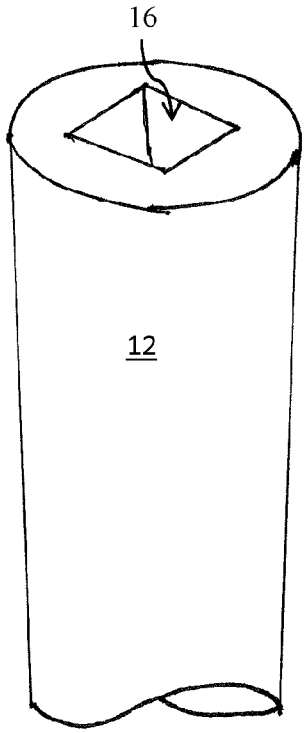
FIG. 7 is an perspective view illustrating an extruded core cylinder for sheathing with a solid wood shell configured in accordance with one embodiment of the present invention.
Figure 8:
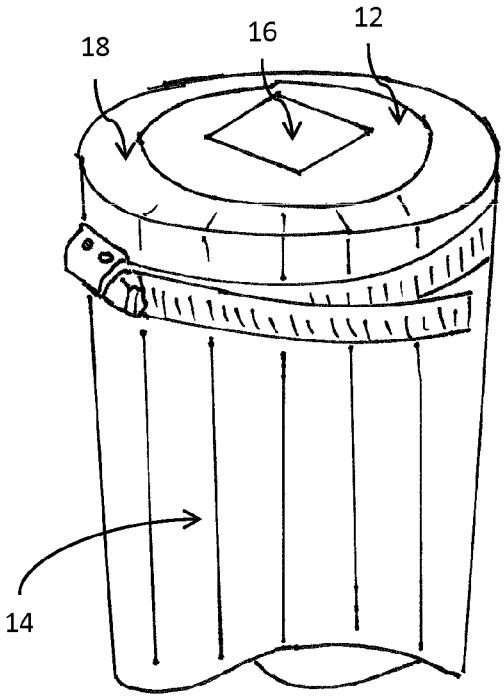
FIG. 8 is an elevation view illustrating an extruded core cylinder with a solid wood shell configured in accordance with one embodiment of the present invention undergoing clamping.
Figure 9:
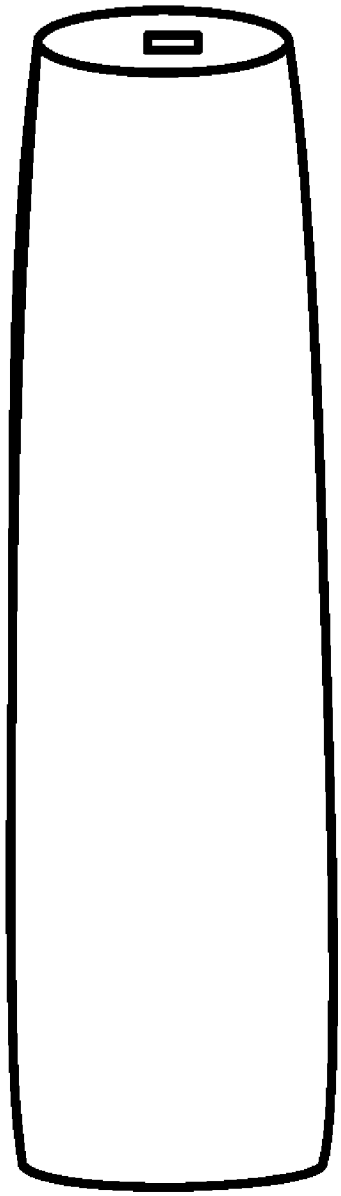
FIG. 9 is a prospective drawing illustrating a structural cylinder having a shell having a non-cylindrical profile configured in accordance with one embodiment of the present invention.

In one embodiment of the present invention, illustrated in FIG. 6 a slot 22 may be machined in one or more of the staves to allow the introduction of a tongue or anchor into the roll so as to facilitate the anchorage of the material to be wound upon the roller to the roller. Alternative retention means, including a spiraled cross section, and a plurality of retention slots are illustrated in FIGS. 4 and 5, respectively.

In one embodiment of the present invention, and end cap may be placed over each of the ends of a completed composite core thereby providing improved radial strength. Such caps are known to those skilled in the art and are used with known solid wood cores. In alternative embodiments where such strength is unimportant, such an endcap is unnecessary.

Figure 2A:
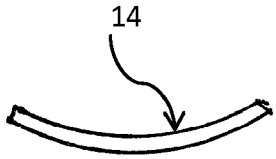
FIG. 2A is a top plan view drawing illustrating a smooth stave of an extruded core cylinder with a solid wood shell configured in accordance with one embodiment of the present invention.
Figure 3A:
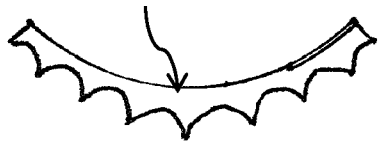
FIG. 3A is a top plan view drawing illustrating a fluted stave of an extruded core cylinder with a solid wood shell configured in accordance with one embodiment of the present invention.
Figure 2B:
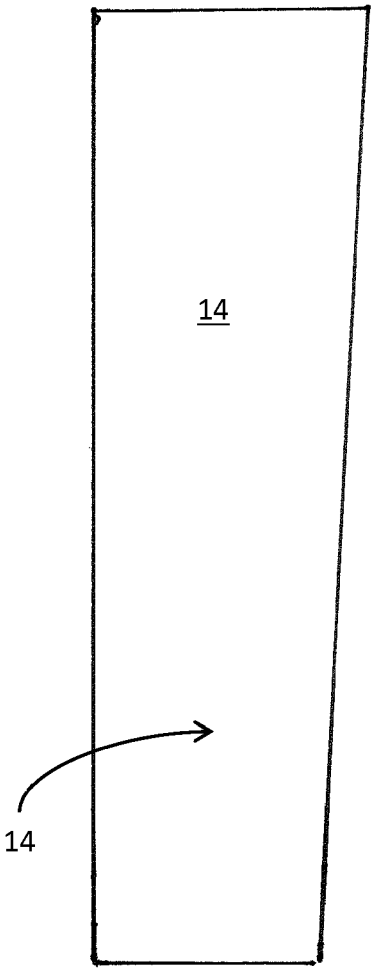
FIG. 2B is an elevation view drawing illustrating a smooth stave of an extruded core cylinder with a solid wood shell configured in accordance with one embodiment of the present invention.
Figure 3B:
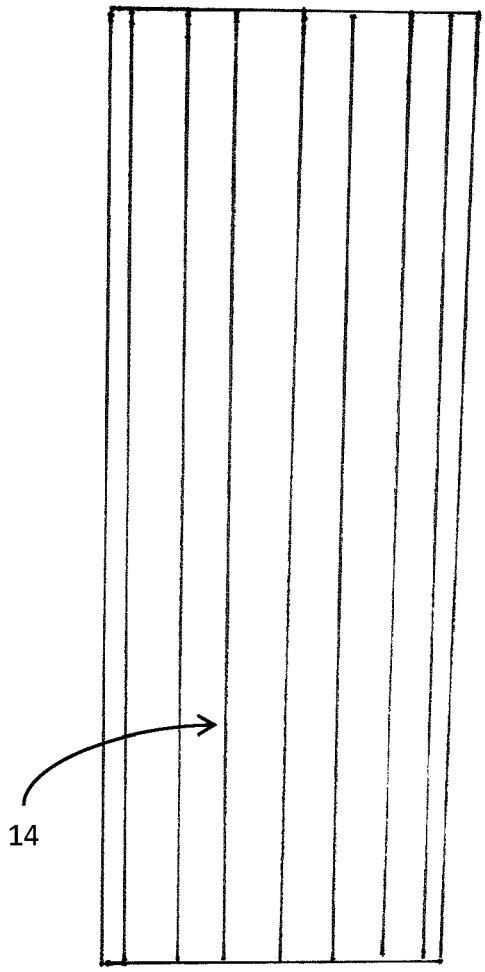
FIG. 3B is an elevation view drawing illustrating a fluted stave of an extruded core cylinder with a solid wood shell configured in accordance with one embodiment of the present invention.
Figure 2C:
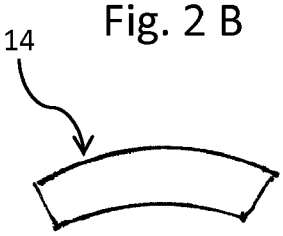
FIG. 2C is a bottom plan view drawing illustrating smooth stave of an extruded core cylinder with a solid wood shell configured in accordance with one embodiment of the present invention.
Figure 3C:
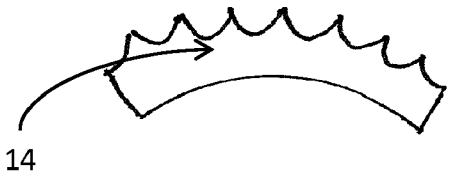
FIG. 3C is a bottom plan view drawing illustrating a fluted stave of an extruded core cylinder with a solid wood shell configured in accordance with one embodiment of the present invention.

In one embodiment of the invention, the staves 14 may be configured with an exterior profile such that when each stave 14 is applied to the core 12 such that the elongate length of the stave 14 is parallel to the axis of the core 12, the exterior profile of the stave is rounded to form an arc, and the arcs of the eight staves combine to form a circular cross section. In alternative embodiments where the core may be used as structural or esthetic architectural element, the staves may be machined prior to application to provide a suitable taper to the column, as illustrated in FIGS. 2A-2C, or in some embodiments fluting as illustrated in FIGS. 3A-3C. Such a taper may be obtained by applying a "shoe" to the stave during machining. In such esthetic embodiments, the staves may be applied to the core without nails, so as to avoid marring the surface of the lumber, alternatively an additional step may be employed wherein nail holes are filled with wood putty prior to sanding and finishing. One skilled in the art can appreciate that suitable capitals or other ornamental end pieces may be applied.

The interior profile of each stave 14, in one embodiment is curved to provide optimum contact with the exterior surface of an extruded core having a circular cross section. As noted above, in one embodiment, staves may comprise eight staves disposed about the circumference of the extruded core, while in alternative embodiments, different numbers of staves may be employed. Similarly, various cross-sectional shapes may be imparted to the extruded cores. In alternative embodiments where extrusions of square, polygonal, pentagonal, hexagonal, heptagonal, octagonal, nonagonal, or decagonal cross section or cross sections of any number of sides, staves with flat interior sides may be provided. In such embodiments same number of staves as of sides may be used. Similarly, in other alternative embodiments, staves may be milled to match the profile of the extruded core. It is noted, however, that polygonal cross sections can reduce the waist rate of the milled staves as the milled stave need only be milled on the exterior.

Wood used in the construction of staves may, in one embodiment be wood from trees of the genus *Populus*. Other inexpensive, easily milled, woods may be used. The density of the wood may likewise be selected based upon factors including the desired durability of the unit produced, the weight and strength requirements, and a need for relative flexibility may be considered. Other suitable woods may include softwoods such as pine or hardwoods such as oak or maple. Exotic species, like mahogany, rosewood, and teak may also be used in applications where the esthetics of the finished piece require such woods.

Glues used in the adhesion of the staves to the core are chemically and structurally compatible with the resins used in the core. Degradation of the core could compromise strength of the system. In one embodiment wood glue, such as that available under the trademarks Elmer's and Tightbond, may be used. Alternatively, resins similar to or identical with that used in the wood fiber extrusion may be used. In one such embodiment both the extrusion and the glue are Urea-Formaldehyde resins. The setting of the Urea-Formaldehyde resin may be accelerated using catalysts. Examples of catalysts used include various metal salts, such as aluminum sulfate.

In one embodiment of the present invention, first and second bands 20 are disposed about first and second ends of the shell 18. In one embodiment these bands may be configured from steel or other suitable, high tensile strength material. These bands 20 may be disposed in rabbeted channels disposed in the shell 18. Alternatively, the tightening of the bands 20 may depress the wood staves sufficiently to keep the steel band 20 from contacting items coiled about the shell 18. The ends of the bands 20 may be crimped or buckled to ensure a secure and low profile joint. In some embodiments, the crimp or buckle may be recessed in a receiving recess.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method for the production of winding cores with a solid wood exterior, the method comprising:

Providing a extruded wood core column;

Providing a plurality of solid wood staves having an interior profile mating an exterior profile of said extruded wood column;

Applying an adhesive to said interior profile of said staves and said exterior profile of said core;

Adhering said interior profile of each of said staves to said exterior profile of said core;

Mechanically securing said staves to said core;

Allowing said adhesive to cure providing a winding core with a solid wood exterior.

2. The method of claim 1 further comprising placing at least one steel band about an end of said winding core with said solid wood exterior and embedding said band in said solid wood exterior.

3. The method of claim 1 further comprising disposing at least one end cap on an end of said winding core with said solid wood exterior and crimping said end cap to secure it to said winding core with said solid wood exterior.

4. The method according to claim 1 wherein step of mechanically securing comprises nailing said staves to said extruded core.

5. The method according to claim 1 wherein said step of mechanically securing comprises clamping said staves to said extruded core.

6. The method according to claim 1 further comprising machining said staves from wood of a variety selected from the group of wood varieties consisting of poplar, oak, ash, maple, mahogany, and walnut.

7. The method according to claim 1 further comprising fluting said staves.

8. The method according to claim 1 further comprising shaping said staves such that said solid wood exterior is tapered.

9. The method according to claim 1 wherein said solid wood exterior comprises a parabolic frustrum.

10. A structural winding unit; said structural winding unit comprising:

A extruded winding core comprising wood fiber and a thermoset resin having a central hole coaxial with a major axis of said winding core and an exterior;

A plurality of shaped staves forming a shell, each stave of said plurality of staves disposed about the exterior of said winding core and parallel to said major axis.

11. The structural unit of claim 10 further comprising at least one slot disposed in at least one said stave is provided parallel to said axis.

12. The structural unit of claim 10 wherein said plurality of staves form a cylindrical shell around said core.

13. The structural unit of claim 12 wherein said shell has grooves where said staves meet.

14. The structural unit according to claim 10 wherein said staves are manufactured from a wood, said wood being of a wood species selected from the group of species consisting of poplar, pine, oak, mahogany and walnut.

15. The structural unit according to claim 10 wherein said staves are tapered, such that said staves form a smooth, longitudinally tapered shell around said core.

16. The structural unit of claim 10, wherein said shell is fluted.

* * * * *